US007644687B2

(12) United States Patent
Zauner

(10) Patent No.: US 7,644,687 B2
(45) Date of Patent: Jan. 12, 2010

(54) COOLING CIRCUIT OF INTERNAL COMBUSTION ENGINE

(75) Inventor: Günther Zauner, Peuerbach (AT)

(73) Assignee: BRP-Powertrain GmbH & Co KG, Gunskirchen (AT)

( * ) Notice: Subject to any disclaimer, the term of this patent is extended or adjusted under 35 U.S.C. 154(b) by 171 days.

(21) Appl. No.: 11/625,680

(22) Filed: Jan. 22, 2007

(65) Prior Publication Data

US 2008/0173262 A1 Jul. 24, 2008

(51) Int. Cl.
*F02F 1/14* (2006.01)

(52) U.S. Cl. ..... 123/41.79

(58) Field of Classification Search ..... 123/41.31, 123/41.34, 41.44, 41.45, 41.74, 41.79, 41.8, 123/65 R, 73 R; 440/88 R, 88 C
See application file for complete search history.

(56) References Cited

U.S. PATENT DOCUMENTS

| | | | | |
|---|---|---|---|---|
| 5,152,255 | A * | 10/1992 | Fukuda | 123/41.33 |
| 6,312,300 | B1 * | 11/2001 | Asai | 440/88 R |
| 6,712,519 | B2 | 3/2004 | Zauner et al. | |
| 2007/0095305 | A1 * | 5/2007 | Matsuda | 123/41.31 |

FOREIGN PATENT DOCUMENTS

JP 2001-98940 * 4/2001

* cited by examiner

*Primary Examiner*—Michael Cuff
*Assistant Examiner*—Ka Chun Leung
(74) *Attorney, Agent, or Firm*—Osler, Hoskin & Harcourt LLP

(57) ABSTRACT

An two-stroke internal combustion engine includes a cooling circuit having at least one passageway on the exhaust side of the engine for cooling the exhaust side of the engine and at least one passageway on the intake side of the engine for cooling at least a portion of the intake side of the cylinder. The engine also includes at least one cooling channel traversing the engine located in the vicinity of one of the bearings supporting the crankshaft for cooling the bearings.

24 Claims, 9 Drawing Sheets

COOLING CIRCUIT OF INTERNAL COMBUSTION ENGINE

FIELD OF THE INVENTION

The present invention relates generally to cooling circuits of two-stroke internal combustion engine.

BACKGROUND OF THE INVENTION

Two-stroke internal combustion engines in recreational vehicles are typically liquid-cooled or air-cooled. Sometimes, in an air-cooled two-stroke engines, the exhaust side of the engine is positioned facing the front of the vehicle such that the hot exhaust side of the engine faces into the wind and is provided with the maximum amount of air flow. The intake side of the engine is typically cooler than the exhaust side since the intake port of the engine is exposed to the relatively cool fuel-air mixture entering the combustion chamber. For this reason, the cooling of the intake side of the engine has been considered unnecessary. In an air-cooled two-stroke engine, the intake side of the engine can face the rear of the vehicle and therefore has no direct airflow. Nonetheless, relatively small indirect airflow actually reaches the intake side of the engine and it has always been considered adequate since a large portion of the heat generated in the combustion chamber is carried outside the engine by the exhaust gases through the exhaust port and/or transferred to the cylinder head and the exhaust side of the cylinder.

In a liquid-cooled two-stroke engine, cooling fluid is circulated into the cylinder block and cylinder head through a cooling circuit. A water pump, usually positioned on the exhaust side of the engine, pumps cooling fluid under pressure into the crankcase of the engine and the cooling fluid circulates upward through a cylinder jacket at least partially surrounding the cylinder(s) and through passageways in the cylinder head before exiting the engine through a water outlet typically equipped with a thermostat. The now hot cooling fluid is delivered to a radiator which cools the cooling fluid before routing it back into the engine in a continuous cycle.

However, conventional cooling circuit for two-stroke engine may adversely affect the performance of the engine by cooling only portions of the engine. Areas of the engine may not be adequately cooled inducing distortions of the cylinder block which can shorten the life of the engine and reduce its performance. Also, critical components of the engine, such as bearings, may not be adequately cooled which can also shorten the life of the engine and reduce its performance.

Thus, there is a need for a cooling circuit for a two-stroke engine that alleviates some of the drawbacks of prior cooling circuits and preferably improves the performance and reliability of the two-stroke engine.

STATEMENT OF THE INVENTION

One aspect of the present invention is to provide an internal combustion engine having an exhaust side and a side opposite the exhaust side, the engine comprising: a crankcase, a crankshaft adapted to rotate about a crankshaft axis, and at least two bearings supporting the crankshaft within the crankcase; at least one cylinder having a cylinder axis and a cylinder head above the at least one cylinder, the at least one cylinder and the cylinder head together defining at least one combustion chamber; a piston disposed in the at least one cylinder and operatively connected to the crankshaft; an intake port connected to the at least one cylinder for allowing at least one combustion component to enter the at least one combustion chamber; an exhaust port connected to the at least one cylinder for allowing exhaust gas to escape the at least one combustion chamber; a liquid cooling circuit including: a cylinder cooling jacket at least partially surrounding the at least one cylinder, and at least one cooling passageway within the crankcase on the side opposite the exhaust side of the engine, the at least one cooling passageway disposed above the crankshaft axis; and the internal combustion engine operating on a two-stroke principal.

In another aspect, the crankcase is horizontally split into an upper half and a lower half, the at least one cooling passageway on the second side of the engine being within the upper half of the crankcase.

In a further aspect, the cooling circuit further comprises at least one passageway on the exhaust side of the engine within the upper half of the crankcase and at least one channel traversing the upper half of the crankcase and connecting the at least one passageway on the side opposite the exhaust side of the engine with the at least one cooling passageway on the exhaust side of the engine.

In an additional aspect, the at least one channel traversing the upper half of the crankcase is located in the vicinity of one of the at least two bearings supporting the crankshaft for cooling the one of the at least two bearings. Preferably, the at least one channel is aligned with one of the crankcase bearings In a further aspect, the liquid cooling circuit further comprises at least one passageway on the side opposite the exhaust side of the engine traversing the intake port connected to the at least one cylinder. Preferably, the at least one passageway on the side opposite the exhaust side of the engine is located within the supporting members of the cylinders.

Another aspect of the present invention is to provide an internal combustion engine having an exhaust side and a side opposite the exhaust side, the engine comprising: a crankcase, a crankshaft adapted to rotate about a crankshaft axis, and at least two bearings supporting the crankshaft within the crankcase; at least one cylinder having a cylinder axis, and a cylinder head above the at least one cylinder, the at least one cylinder and the cylinder head together defining at least one combustion chamber; a central plane of the engine defined by the cylinder axis and the crankshaft axis, the central plane separating the first side of the engine from the second side of the engine; a piston disposed in the cylinder and operatively connected to the crankshaft; an intake connected to the at least one cylinder for allowing at least one combustion component to enter the at least one combustion chamber; an exhaust port connected to the at least one cylinder for allowing exhaust gas to escape the at least one combustion chamber; and a liquid cooling circuit including: a cylinder cooling jacket at least partially surrounding the at least one cylinder, a first cooling passageway within the crankcase disposed below the crankshaft axis, and a second cooling passageway disposed above the crankshaft axis; the first and second passageways extending across the central plane of the engine, the internal combustion engine operating on a two-stroke principal.

In an additional aspect, the crankcase is horizontally split into an upper half and a lower half and the liquid cooling circuit further comprises at least one cooling channel traversing the upper half of the crankcase and connecting the first and second passageways. Preferably, the cooling circuit includes a plurality of cooling channels traversing the upper half of the crankcase, the plurality of cooling channels aligned with the at least two crankshaft bearings.

One other aspect of the present invention is to provide A snowmobile comprising: a frame having a forward end and a rearward end; a drive track assembly disposed below and supporting the rearward end of the frame; a front suspension connected to the forward end of the frame; two skis connected to the front suspension; a two-stroke engine mounted on the frame and operatively connected to the drive track via a drive train for delivering propulsive power to the drive track; the two-stroke engine comprising: a crankcase, a crankshaft adapted to rotate about a crankshaft axis, and at least two bearings supporting the crankshaft within the crankcase; at least one cylinder having a cylinder axis and a cylinder head above the at least one cylinder, the at least one cylinder and the cylinder head together defining at least one combustion chamber; a central plane of the engine defined by the cylinder axis and the crankshaft axis, the central plane separating an exhaust side of the engine from a side opposite the exhaust side of the engine; a piston disposed in the at least one cylinder and operatively connected to the crankshaft; an intake port connected to the at least one cylinder for allowing at least one combustion component to enter the at least one combustion chamber; an exhaust port connected to the at least one cylinder for allowing exhaust gas to escape the at least one combustion chamber; and a liquid cooling circuit including a cylinder cooling jacket at least partially surrounding the at least one cylinder, a first cooling passageway within the crankcase disposed below the crankshaft axis and a second cooling passageway disposed above the crankshaft axis; the first and second passageways extending across the central plane of the engine.

In the present description, the term "channels" is used to refer to specific passageways in the cooling circuit of the engine, however, for the purposes of this application, "channels" and "passageway" are synonymous.

Embodiments of the present invention each have at least one of the above-mentioned aspects, but not necessarily have all of them.

Additional and/or alternative features, aspects and advantages of the embodiments of the present invention will become apparent from the following description, the accompanying drawings and the appended claims.

BRIEF DESCRIPTION OF THE DRAWINGS

For a better understanding of the present invention as well as other aspects and further features thereof, reference is made to the following description which is to be used in conjunction with the accompanying drawings, where.

DESCRIPTION OF PREFERRED EMBODIMENT(S)

Figure 1:
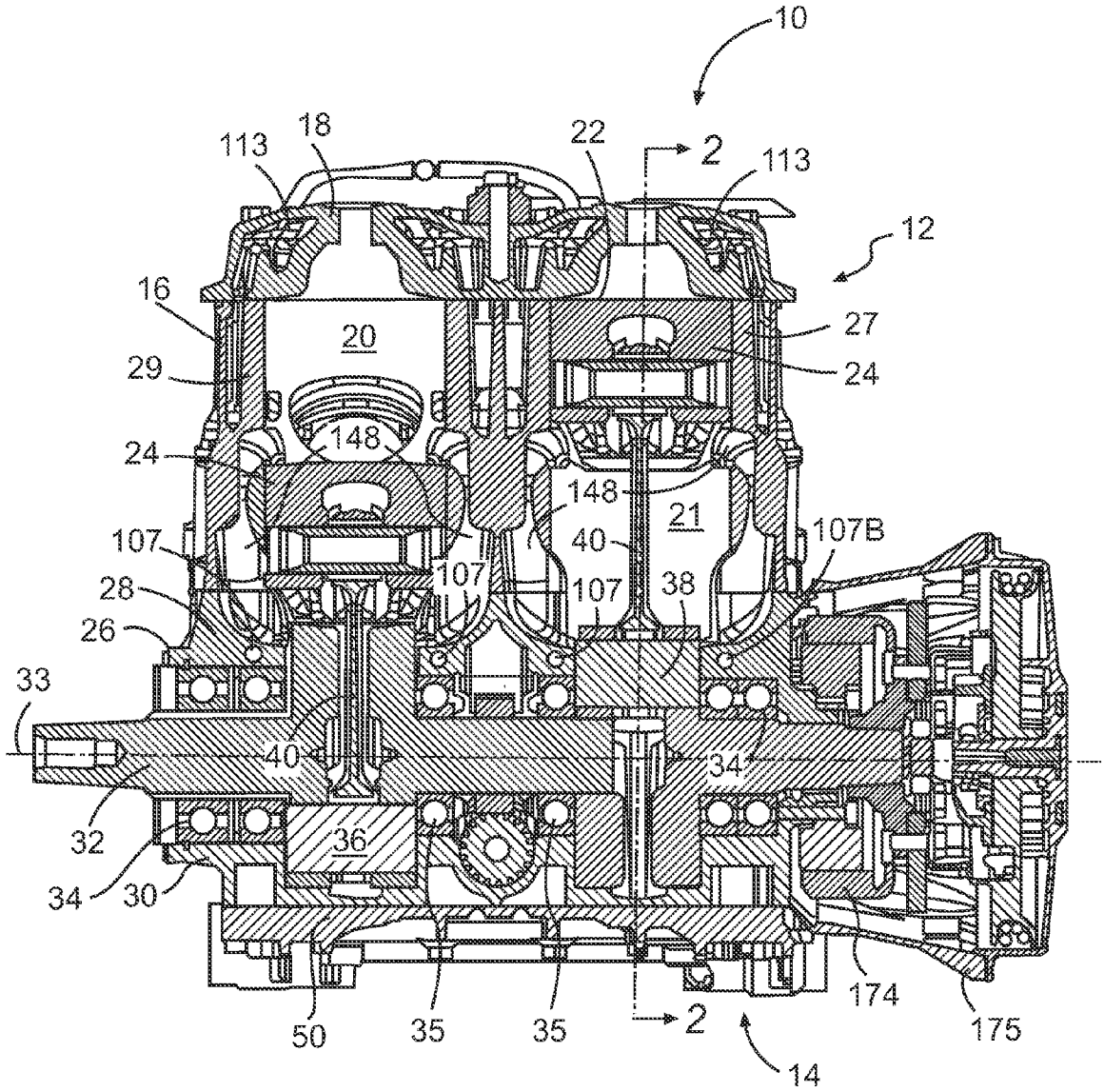
FIG. 1 is a cross-sectional view of a two-stroke internal combustion engine in accordance with one embodiment of the invention taken along the longitudinal axis of the engine.

With reference to FIG. 1, which is a cut-away view of a two-stroke internal combustion engine 10 along its longitudinal axis, the two-stroke engine 10 includes an upper portion 12 and a lower portion 14. The upper portion 12 consists of a cylinder block 16 and a cylinder head 18. The cylinder block 16 includes two cylinders 27 and 29. Each cylinder 27 and 29 having a cylinder axis which coincides with the vertical central plane 101 shown in FIG. 2. The two cylinders and the cylinder head 18 together define two combustion chambers 20 and 22 each housing a piston 24. The lower portion 14 consists of a crankcase 26, which is split along an horizontal plane when the engine 10 is positioned upright with the cylinders 27 and 29 above the crankcase 26. The crankcase 26 includes an upper half 28 and a lower half 30 secured together and supporting a crankshaft 32 via the end bearings 34 and central bearings 35 held within bearing housings formed within the crankcase 26. The crankshaft bearings 34 and 35 are sealed non-friction bearings as described in U.S. Pat. No. 6,712,519 which is incorporated herein by reference, but could alternatively be conventional roller bearings. The crankshaft 32 includes a crankshaft axis 33 about which the crankshaft 32 rotates. The crankshaft axis 33 is substantially horizontal when the two-stroke engine 10 is installed in a frame of a vehicle. The bottom portion of the lower half 30 of the crankcase 26 is closed and sealed by a base plate 50. The upper portion 12 is assembled to the lower portion 14 by securing the cylinder block 16 to the upper half 28 of the crankcase 26. The upper half 28 of the crankcase 26 and the lower portion of the cylinder block 16 together define a crankcase chamber 21 under each piston 24. The pistons 24 are connected to the connecting rod journals 36 and 38 of the crankshaft 32 via connecting rods 40 such that reciprocal movement of the pistons within the cylinders is transferred to the crankshaft 32 as rotational movement. The crankshaft 32 also drives an electrical generator 174 connected to one end of the crankshaft 32 and enclosed within an ignition housing cover 175. The two-stroke internal combustion engine 10 is an in-line two cylinder engine having a volumetric displacement of 400 cc. In other embodiments, the two-stroke internal combustion engine 10 has a volumetric displacement of 400 cc or more. For instance, the two-stroke internal combustion engine 10 can have a volumetric displacement of 550 cc or more.

Figure 2:
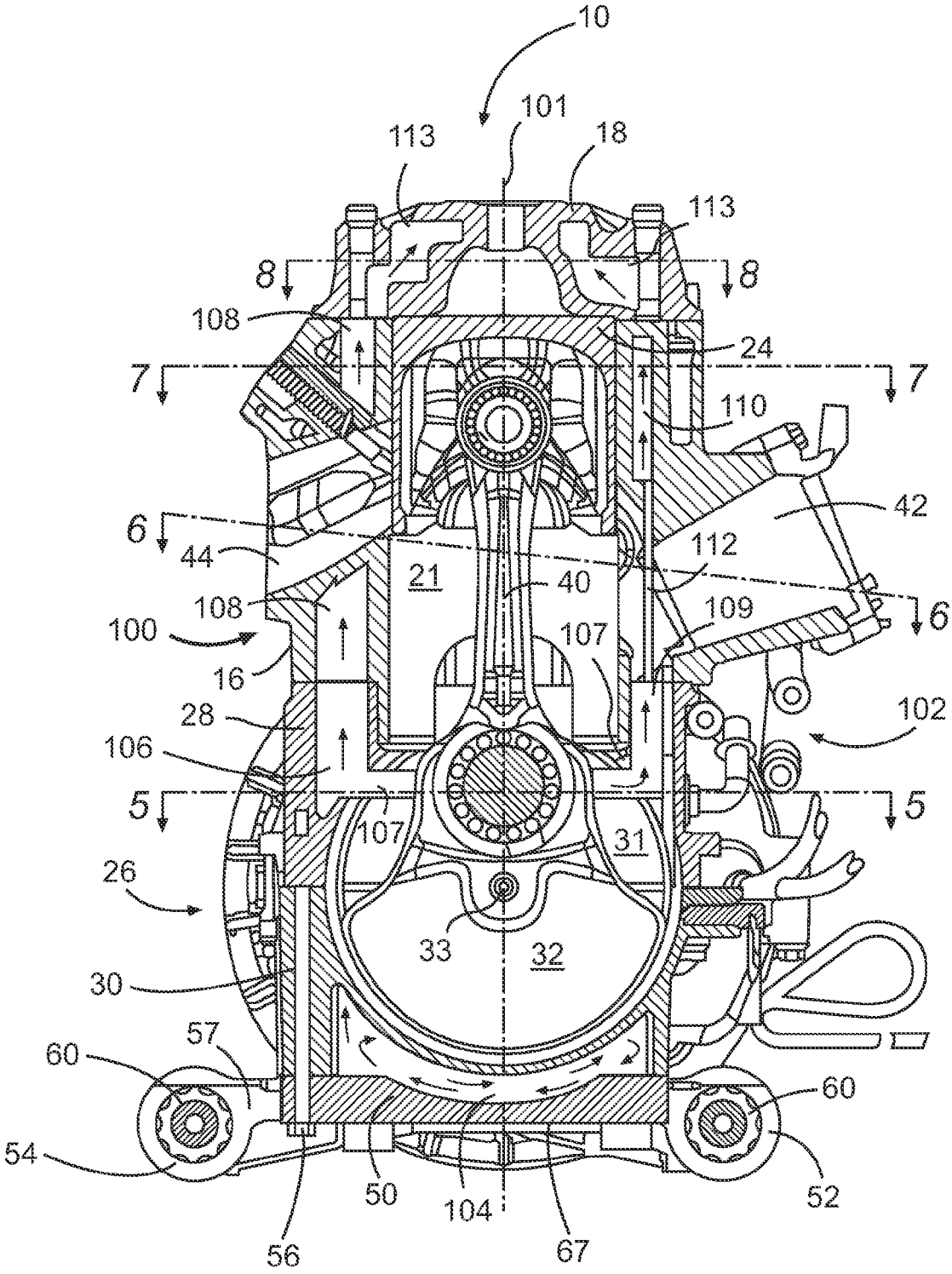
FIG. 2 is a cross-sectional view of the two-stroke internal combustion engine taken along line 2-2 of FIG. 1.

As shown in FIG. 2, the base plate 50 includes engine mounts 52 and 54 extending from the outer edge of the base plate 50 for securing the engine 10 to a frame. The engine mounts 52 and 54 are integral with the base plate 50 and form a single component. The base plate 50 is secured to the bottom portion of the lower half 30 of the crankcase 26 by a series of bolts 56 such that the base plate 50 closes and seals the crankcase 26 and also solidly connects the engine mounts 52 and 54 to the engine 10. Each engine mount 52 and 54 is cylindrical and comprises a resilient member 60 inserted therein which is adapted to dampen vibrations emanating from the engine 10. The resilient members 60 therefore partially isolate the engine 10 from the frame when the engine 10 is mounted to the frame of a recreational vehicle. The internal combustion engine 10 includes a cooling circuit that circulates fluid throughout the engine 10 to avoid thermal overload of the engine components.

With reference to FIG. 2, which is a schematic cut-away view of the two-stroke internal combustion engine 10 of FIG. 1, the two-stroke engine 10 includes an exhaust side 100 and an intake side 102. The exhaust side 100 of the engine is disposed on one side of a vertical central plane 101 passing through the crankshaft axis 33 and the intake side 102 of the engine 10 is disposed on the other side of the vertical central plane 101.

The cylinder block 16 includes an intake port 42, located on the intake side 102, which allows ingress of at least one combustion component of the fuel-air mixture into the combustion chamber 20 when the piston 24 is at the bottom end of its stroke and an exhaust port 44, located on the exhaust side 100, which allows the burned gas mixture to exit the combustion chamber 20 when the piston 24 is half way down its power stroke. Referring back to FIG. 1, the cylinder block 16 includes transfer ports 148 which link the crankcase chambers 21 with the combustion chambers 20 and 22. As is known in the art, rotation of the crankshaft 32 causes each piston 24 to reciprocate in its respective cylinder between a bottom dead center and a top dead center, acting as a pump and opening and closing the intake ports 42 and the transfer ports 148 in the cylinders to effectuate the combustion process. Referring to FIGS. 1 and 2, as a piston 24 moves up its cylinder, it creates a vacuum in its respective crankcase chamber 21. This vacuum causes an intake charge to enter that crankcase chamber 21 from the intake port 42. As the piston 24 moves down in the cylinder, it pressurizes the intake charge until the transfer ports 148 are uncovered by the piston 24, whereupon the intake charge is forced from the crankcase chamber 21 to the interior of the combustion chamber 20 through the transfer ports 148. As the piston 24 moves up again in the cylinder, it compresses the intake charge in the cylinder into the combustion chamber for combustion while simultaneously again causing an intake charge to be sucked into the crankcase chamber 21.

As illustrated in FIG. 2, the lower half 30 of the crankcase 26 includes cooling chambers 104 surrounding the lower part of the crankshaft cavity 31. The upper half 28 of the crankcase 26 includes passageways 106 on the exhaust side of the engine 10 in fluid communication with the cooling chambers 104. Cooling channels 107 (i.e passageways) traverses the upper half 28 of the crankcase 26 directly adjacent to the bearings 34 of the crankshaft 32 as shown in FIG. 1 and link the passageways 106 to passageways 109 located on the intake side 102 of the engine 10. The use of non-friction bearings requires additional cooling as opposed to roller bearings. The location of the cooling channels 107 in close proximity above the bearings 34 and 35 enables to efficiently cool the upper parts of the bearings 34 and 35. Furthermore, the cooling channels 107 help to lower the temperature of the crankcase chambers 21 thereby improving engine performance as a larger quantity of intake charge can be introduced into the crankcase chambers 21.

The cylinder block 16 includes passageways 108 surrounding the exhaust port 44 and passageways 110 on the intake side 102 of the engine 10 surrounding a portion of the combustion chamber 20. The passageways 110 are linked to the passageways 109 of the upper half 28 of the crankcase 26 by small passageways 112 extending along the intake side 102 of the combustion chamber 20. The small passageways 112 traverse the supporting members 152 (FIG. 6) of the intake port 42. The passageways 108 are in fluid communication with the passageways 106 of the upper half 28 of the crankcase 26 and are also in fluid communication with the passageways 110 at the top portion of the cylinder block 16. The cylinder head 18 includes cooling chambers 113 in fluid communication with the passageways 108 and 110. The cylinder head 18 also includes a water outlet 165 (FIG. 3).

Figure 3:
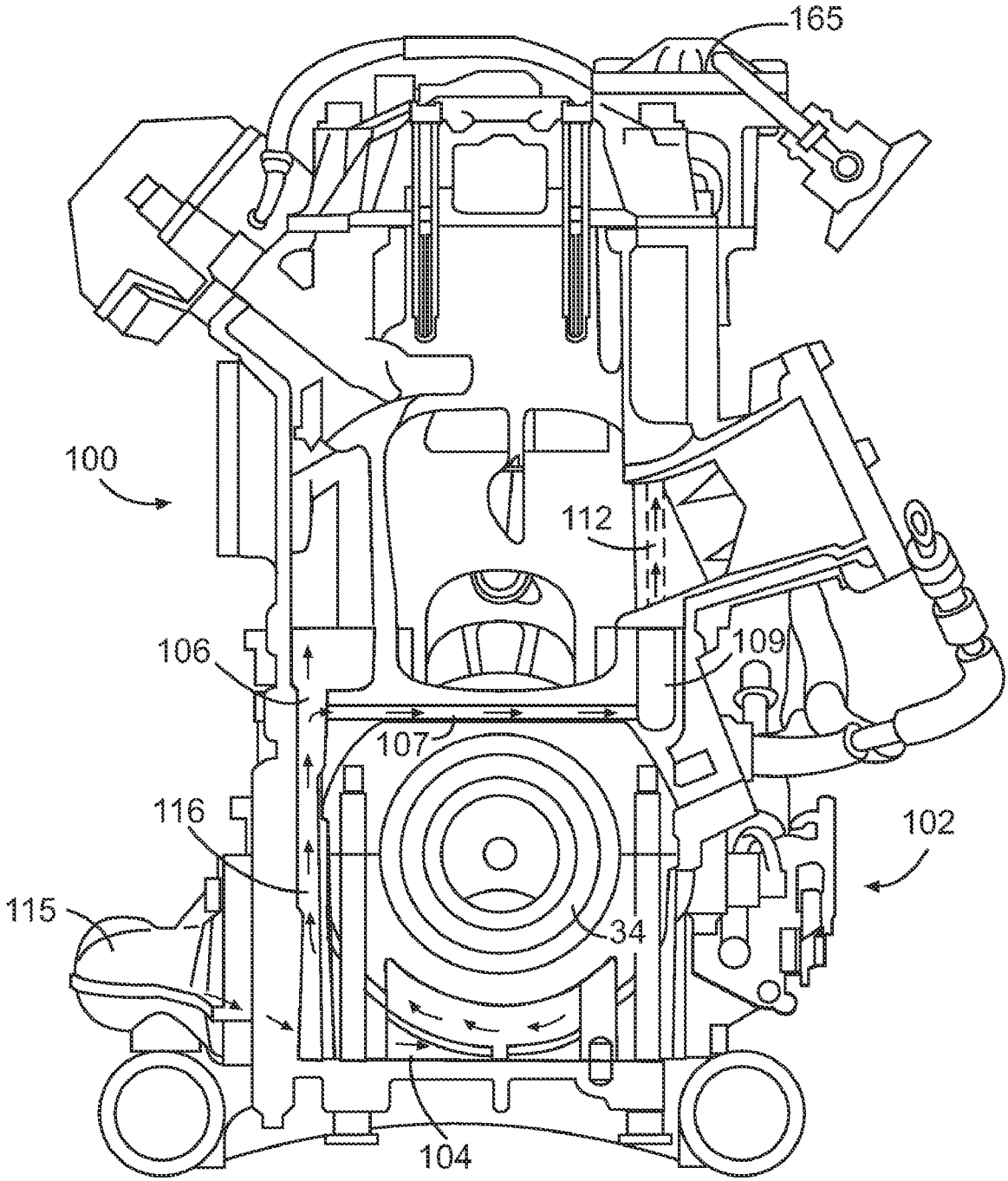
FIG. 3 is a vertical cut-away view of the two-stroke internal combustion engine illustrating schematically the cooling passageways in the crankcase of the two-stroke internal combustion engine shown in FIG. 1.

With reference to FIG. 3, in operation, cooling fluid is fed under pressure by the water pump 115 into the cooling chambers 104 of the crankcase 26 to cool the lower portion of the main bearings 34, the lubricating oil of the main bearings 34 as well as the walls of the crankcase 26. The cooling chambers 104 are provided with venting ports 111 best shown in FIG. 5 that allow air to escape the cooling chambers 104 and prevent pressure build-up in the cooling chambers 104. The cooling fluid winds it way around the cooling chambers 104 and is routed upwards through cooling channels 116 to the passageways 106 in the upper half 28 of the crankcase 26. A fraction of the cooling fluid is diverted across the engine 10 through cooling channels 107 into the passageways 109 on the intake side 102 of upper half 28 of the crankcase 26 and in the process cools the upper portion of bearings 34 and 35 and also cools the crankcase chambers 21 located above the cooling channels 107. The cooling fluid is then routed upwards into the cylinder block 16 on the exhaust side 100 and the intake side 102 of the engine 10.

Figure 4:
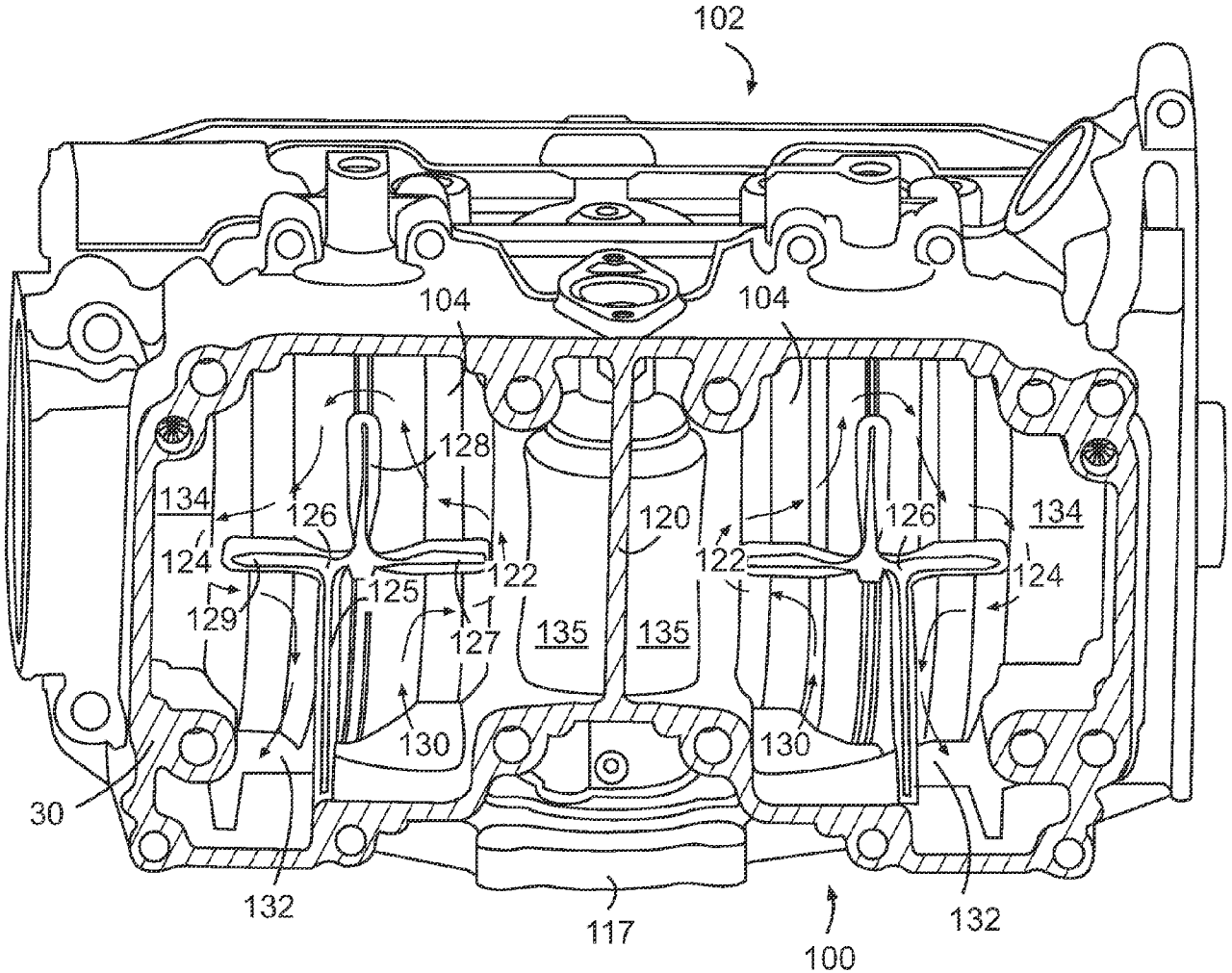
FIG. 4 is a bottom perspective view of the inside of the crankcase of the two-stroke internal combustion engine shown in FIG. 1.

With reference to FIG. 4, which is a bottom view of the lower half 30 of the crankcase 26, the initial portion of the engine cooling circuit comprises two cooling chambers 104 divided by a partition wall 120. Each cooling chamber 104 is divided into an inlet side 122 and an outlet side 124 by a guiding wall 126 in the general shape of a cross which directs the flow of cooling fluid around the cooling chamber 104. The water pump 115 (FIG. 3) is mounted to the water pump bracket 117 and is in fluid communication with both cooling chambers 104 through a pair of inlet ports 130 located on the inlet side 122 of each cooling chamber 104. The cooling fluid under pressure is forced to circle the entire cooling chamber 104 as it is directed by the guiding walls 126 as shown by the arrows illustrating the general path in which the cooling fluid follows in each cooling chamber 104. In the inlet side 122 of each cooling chamber 104, the cooling fluid is initially directed by the first and second legs 125, 127 of the guiding walls 126, onto the bottom portion of the bearings housing 135 to cool the central bearings 35 (FIG. 1). The cooling fluid is then routed around the third leg 128 and directed by the fourth leg 129 onto the bottom portion of the bearings housing 134 to cool the end bearings 34 (FIG. 1). The cooling fluid is finally directed by the first leg 125 towards the outlet ports 132 on the outlet side 124 of each cooling chamber 104. The outlet ports 132 are in fluid communication with the passageways 106 located in the upper half 28 of the crankcase 26.

Figure 5:
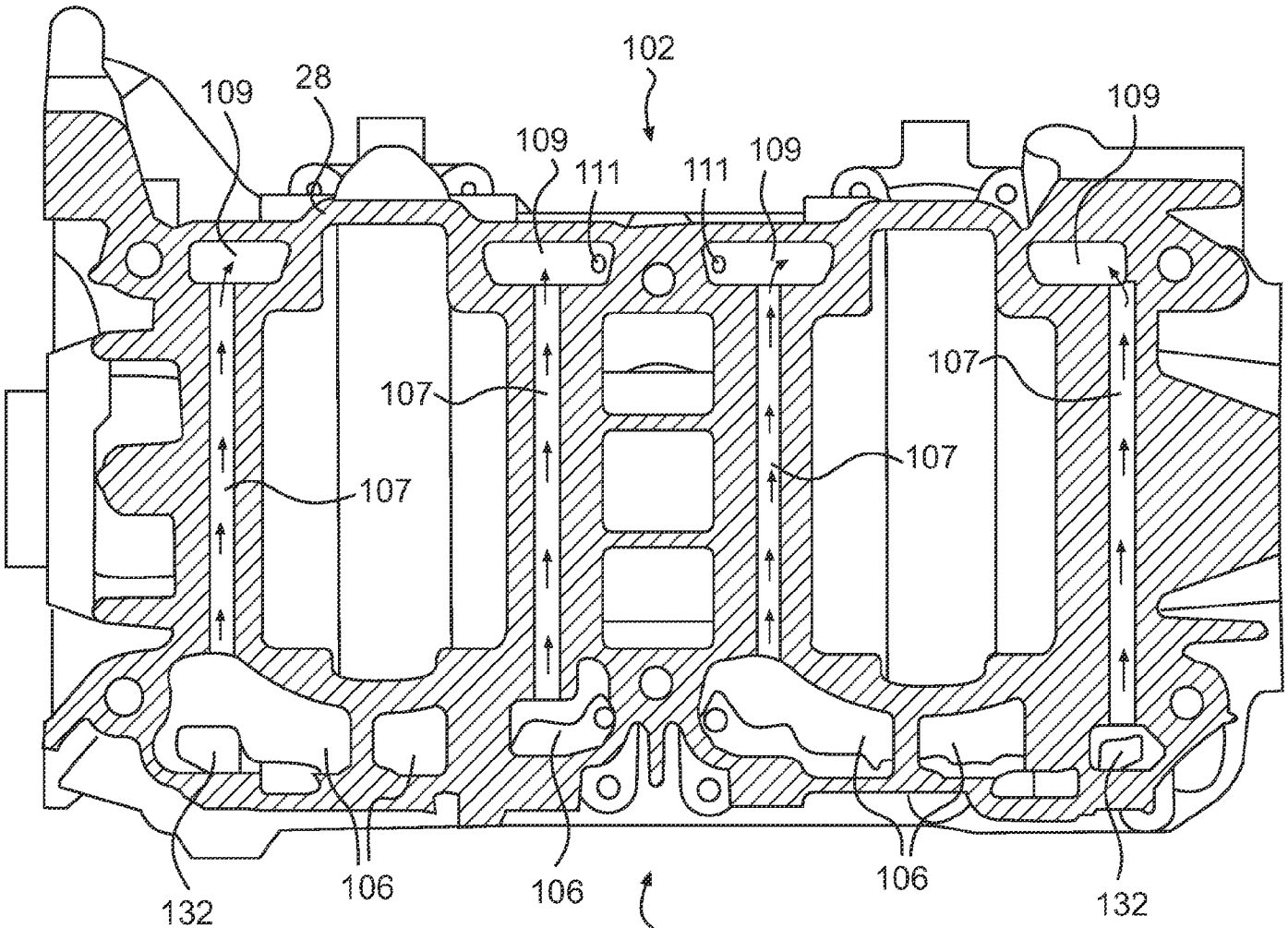
FIG. 5 is a cross-sectional view of the two-stroke internal combustion engine taken along line 5-5 of FIG. 2.

Referring now to FIG. 5, which is a cut-away view of the upper half 28 of the crankcase 26 taken at line 5-5 of FIG. 2, the cooling fluid enters the passageways 106 through the outlet ports 132 located at both ends of the upper half 28 of the crankcase 26, on the exhaust side 100 of the engine 10, and fills the passageways 106. A portion of the cooling fluid is diverted across the engine 10 and traverses the upper half 28 of the crankcase 26 through cooling channels 107 to reach the passageways 109 on the intake side 102 of the upper half 28 of the crankcase 26. Each cooling channel 107 is aligned with, and passes in the vicinity of the crankshaft end bearings 34 or central bearings 35 as shown in FIGS. 1 and 2 such that the cooling fluid circulating therethrough cools the upper portion of bearings 34 and 35. The cooling channels 107 are positioned between the crankcase chambers 21 and the upper portion of bearings 34 and 35 such that the cooling fluid absorbs heat transferred from the combustion chambers and cools the crankcase chambers 21. The cooling channels 107 thereby prevent excessive heat from reaching the bearings and also absorb heat generated by the bearings themselves.

The cooling channels 107, being adjacent the crankshaft bearings 34 and 35, provide additional cooling for the crankshaft bearings 34 and 35 such that the lubricating oil of the crankshaft bearings is less likely to overheat in contact with the bearings and the lubrication of the crankshaft bearings is optimal. The cooling channels 107 enhance the reliability of the crankshaft bearings and the latter are less likely to fail or not perform up to the engine requirements. Furthermore, the proximity of a cooling channel 107 near one end of the crankshaft 32 and near the generator 174 (FIG. 1) also serves to cool the generator 174.

The cooling fluid then fills the passageways 109 and cools the intake side 102 of the upper half 28 of the crankcase 26. Passageways 109 provide cooling of the intake side 102 of the engine 10 and ensure that the engine 10 is more uniformly cooled than conventional two-stroke engines which are only cooled on their exhaust side.

Figure 6:
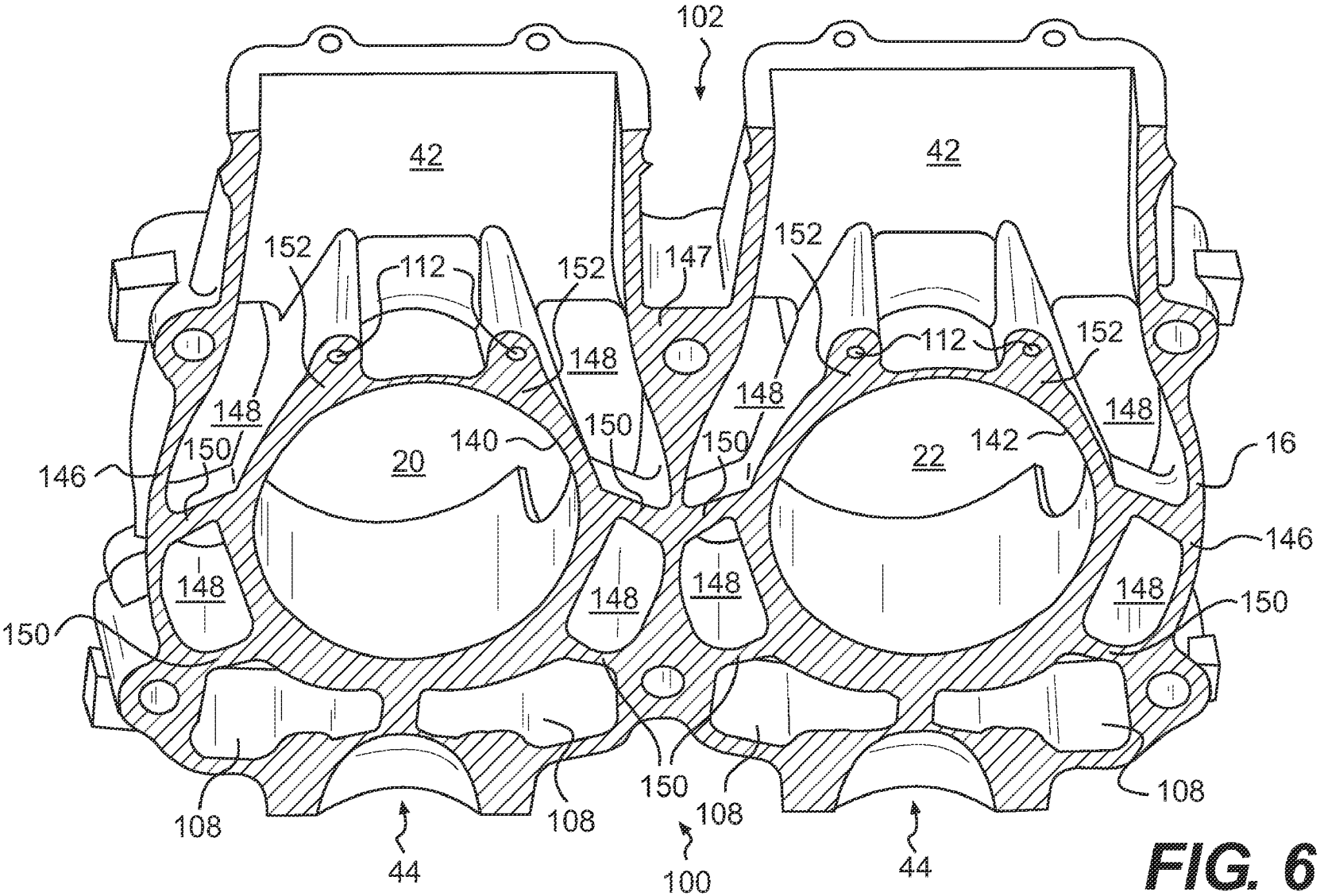
FIG. 6 is a cross-sectional view of the two-stroke internal combustion engine taken along line 6-6 of FIG. 2.

Referring back to FIG. 3, from the passageways 109 located on the intake side 102 of the upper half 28 of the crankcase 26, the cooling fluid is routed through small passageways 112 which traverse the intake port 42 of the engine 10. As shown in FIG. 6, which is a cut-away view of the cylinder block 16 taken at line 6-6 of FIG. 2, the cylinder block 16 includes cylinder walls 140 and 142 which respectively define the outer periphery of the combustion chambers 20 and 22 and structural walls 146 and 147. The cylinder walls 140 and 142 are separated from the structural walls 146 and 147 by the cooling passageways 108 on the exhaust side 100 of the cylinder block 16, by the intake ports 42 and by the transfer ports 148. The cylinder walls 140 and 142 are connected to the structural walls 146 and 147 by supporting members 150 and 152 which maintain the structural integrity and cylindrical shape of the cylinder walls 140 and 142. The cooling passageways 108 on the exhaust side 100 of the cylinder block 16 cool the exhaust side of the cylinder walls 140 and 142 as well as the hot exhaust ports 44. On the intake side 102 of the cylinder block 16, the supporting members 152 located within the intake ports 42 are provided cooling passageways 112 through which the cooling fluid is routed from the passageways 109 of the upper half 28 of the crankcase 26. The cooling fluid running through the passageways 112 and therefore through the supporting members 152 cools the intake portion of the cylinder walls 140 and 142 and again provides a more uniform cooling of the engine 10 than in conventional two-stroke engines. The cooling passageways 112 ensure that the supporting members 152 do not overheat for lack of cooling and that the temperature gradient between the intake side 102 and the exhaust side 100 of the cylinder walls remains within a limit to prevent distortion of the cylinder walls. Without appropriate cooling of the supporting members 102, heat may build-up on the intake side 102 of the cylinder walls 140 and 142 causing warping or distortion of the cylinders which negatively affects the performance and durability of the engine 10.

Figure 7:
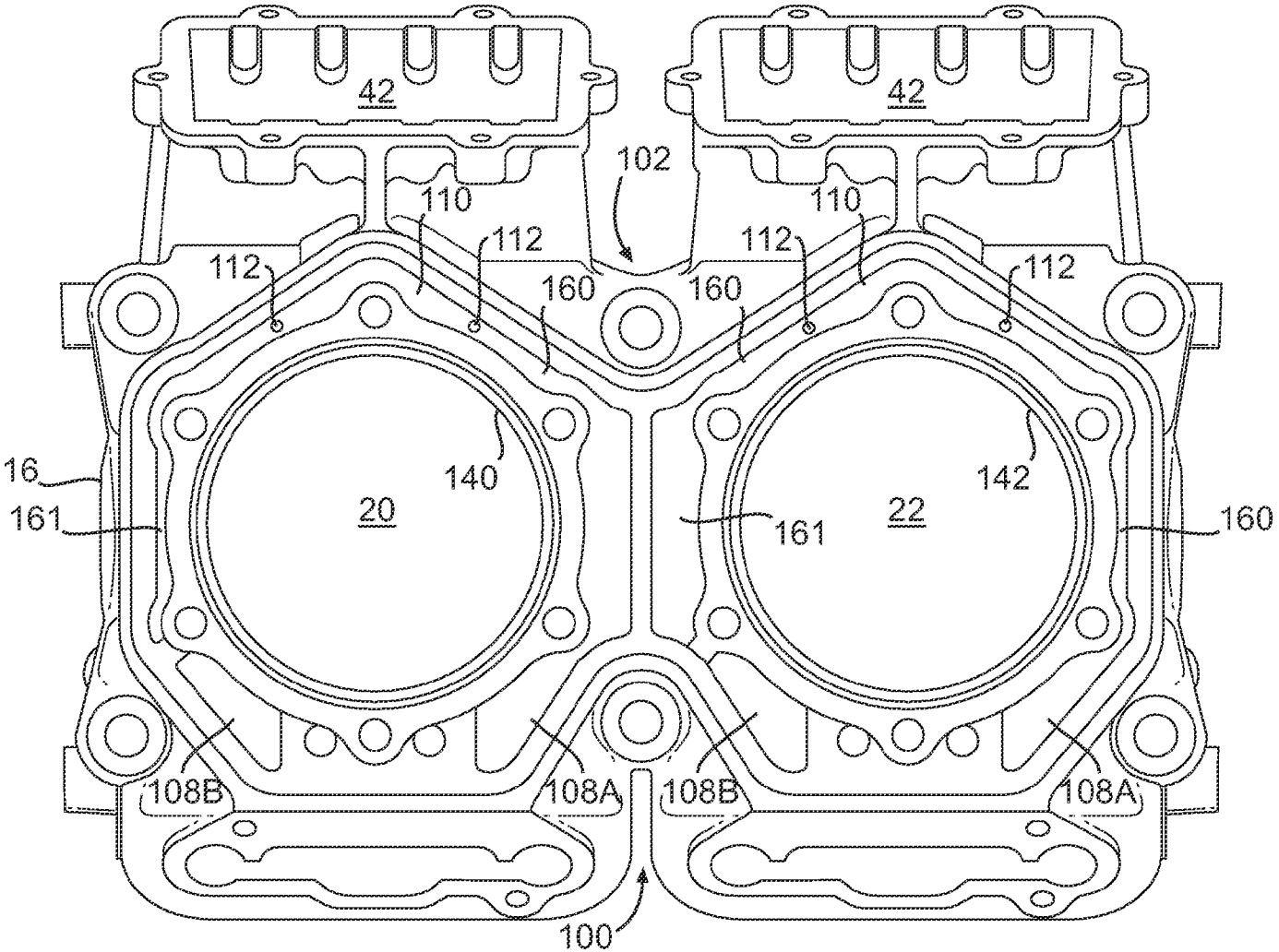
FIG. 7 is a cross-sectional view of the two-stroke internal combustion engine taken along line 7-7 of FIG. 2.

Referring back to FIG. 2, from the passageways 109 located on the intake side 102 of the upper half 28 of the crankcase 26, the cooling fluid is routed through the passageways 112 which traverse the supporting members 152 in the intake port 42 of the engine 10 into the passageways 110 located above the intake port 42 in the top portion of the cylinder block 16. As can be seen in FIG. 7, which is a cut-away view of the cylinder block 16 taken at line 7-7 of FIG. 2, the passageways 110 located on the intake side 102 of the cylinder block 16 are in fluid communication with the passageways 108 on the exhaust side 100 of the cylinder block 16. The passageways 108A and 110 together define cylinder cooling jackets 160 that surrounds almost the entire periphery of the cylinder walls 140 and 142. Cooling fluid enters the passageways 108A and 108B from below. Cooling fluid entering passageways 108A circulates into the cylinder cooling jackets 160 around the cylinder walls 140 and 142 towards the exits 161 leading to the cooling chambers 113 of the cylinder head 18 (FIG. 2). Cooling fluid also enters the cylinder cooling jackets 160 through the passageways 112 and joins the flow of cooling fluid from the passageways 108A circulating towards the exits 161. As the cooling fluid circulates around the cylinder cooling jackets 160, it cools the periphery of the cylinder walls 140 and 142. Cooling fluid circulating through the passageways 108B is routed directly above into the cooling chambers 113 of the cylinder head 18 (FIG. 2).

Figure 8:
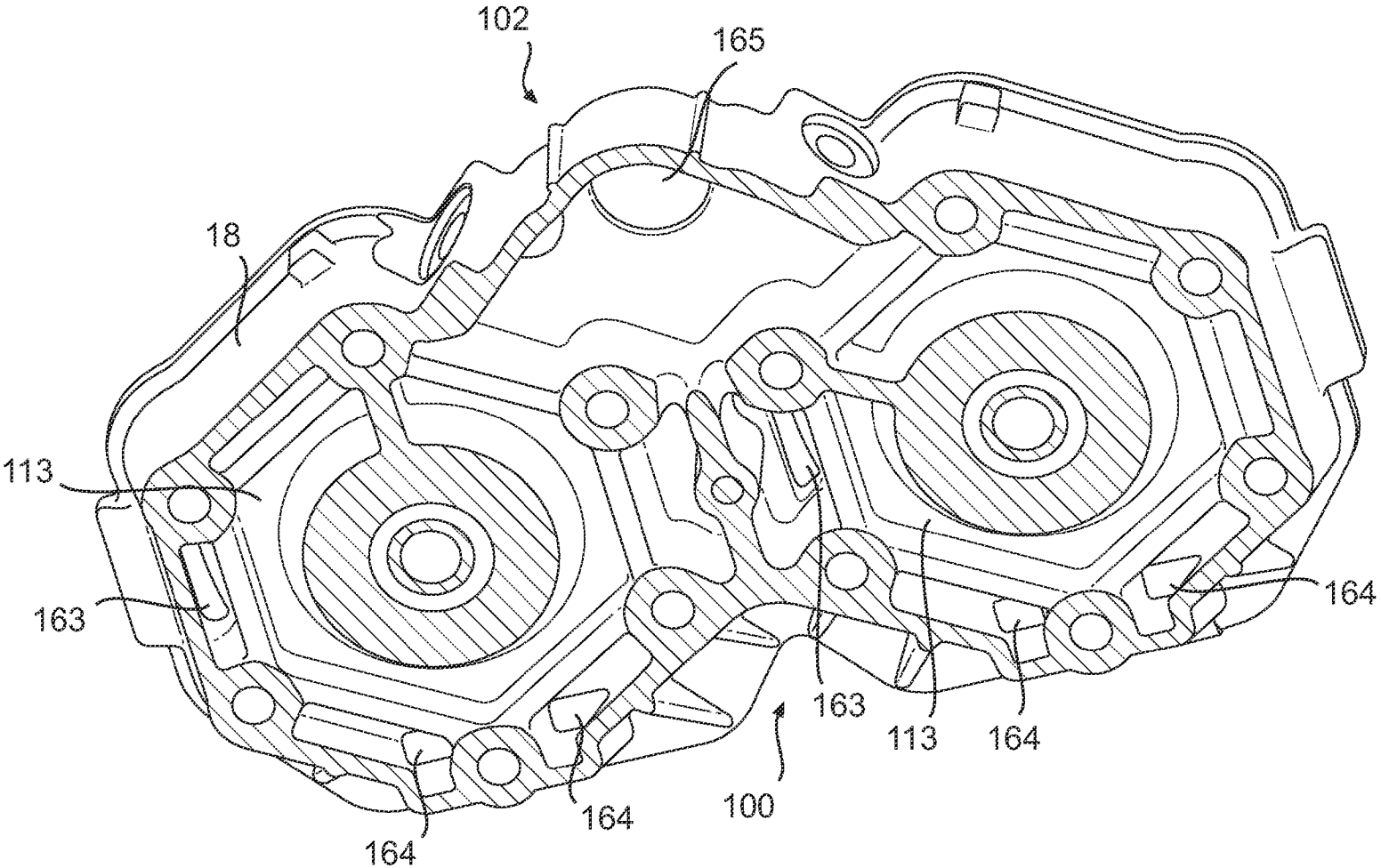
FIG. 8 is a cross-sectional view of the two-stroke internal combustion engine taken along line 8-8 of FIG. 2.

With reference to FIG. 8, which is a cut-away view of the cylinder head 18 taken at line 8-8 of FIG. 2, the cooling fluid enters the cooling chambers 113 of the cylinder head 18 from inlets 163 which are directly aligned with the exits 161 of the cylinder block 16 (FIG. 7) as well as from inlets 164 which are in fluid communication with the passageways 108A and 108B of the cylinder block 16 (FIG. 7). The cooling fluid circulates within the cooling chambers 113 and in the process cools the hot cylinder head 18 before exiting through the water outlet 165 shown in FIG. 3.

The cooling circuit of the present invention helps to provide improved cooling of the two-stroke engine 10 by diverting a portion of the cooling fluid to the intake side 102 of the engine 10. In the process, the present cooling circuit provides cooling for the top portion of the crankshaft bearings 34 and 35 and cooling for the crankcase chambers 21. The present cooling circuit also provides cooling of the supporting members 152 of the cylinder walls 140 and 142 to prevent potential distortion of the combustion chambers 20 and 22 thereby increasing the reliability of the engine 10.

The illustrated two-stroke internal combustion engine 10 has a volumetric displacement of at least 400 cc, and preferably 550 cc. The power output of the two-stroke engine 10 at the crankshaft is at least 80 KW, and preferably at least 90 KW. The two-stroke engine 10 is preferably installed in a recreational vehicle such as a snowmobile or an All-Terrain Vehicle (ATV).

Figure 9:
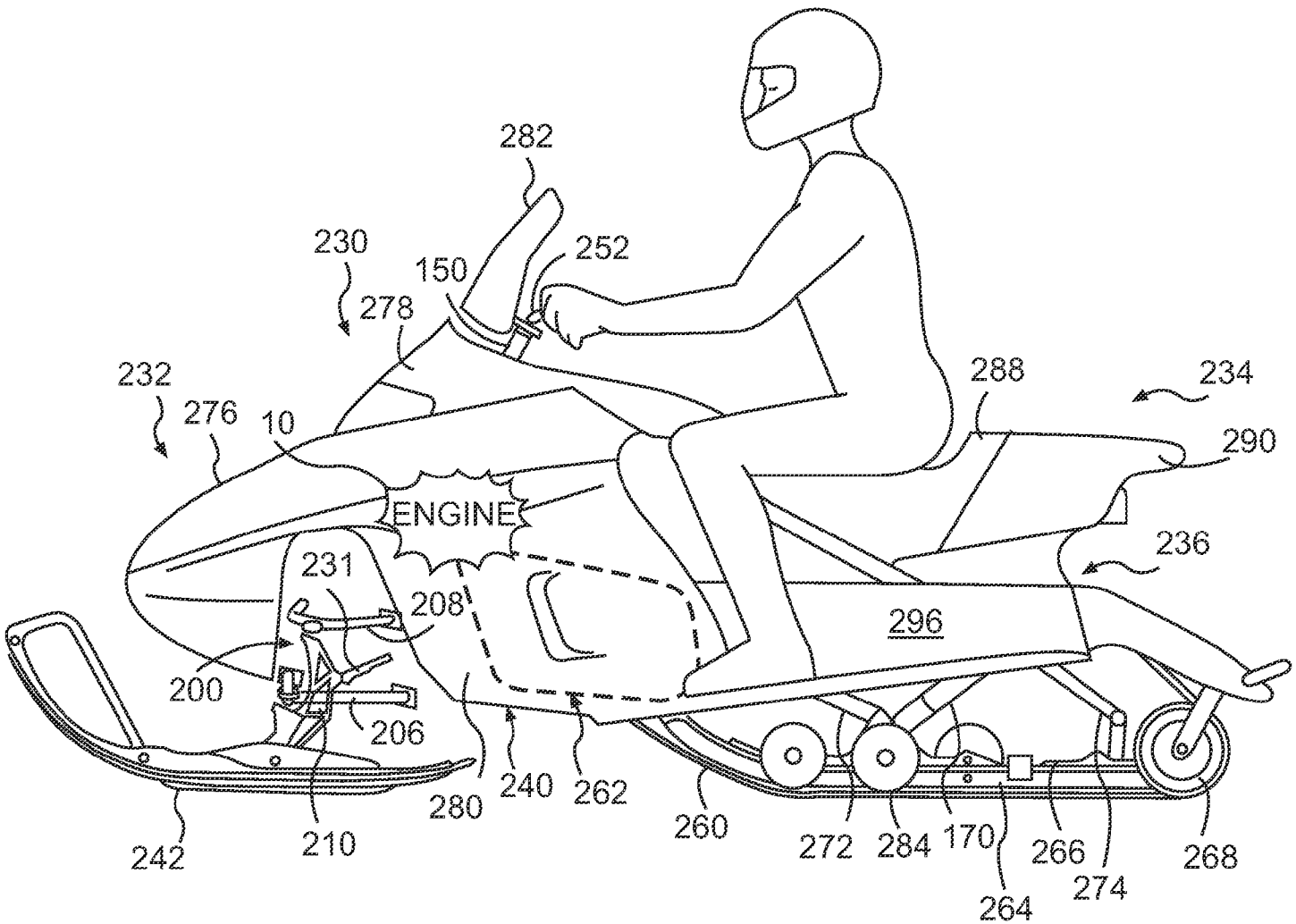
FIG. 9 is a side elevational view of a snowmobile including a two-stroke internal combustion engine in accordance with one embodiment of the invention.

FIG. 9 illustrates a snowmobile 230 in accordance with one specific embodiment of the invention. The snowmobile 230 includes a forward end 232 and a rearward end 234 which are defined consistently with a travel direction of the vehicle. The snowmobile 230 includes a frame 236 comprising an engine cradle portion 240 and a tunnel 296. Tunnel 296 generally consists of an inverted U-shaped bent sheet metal connected to the engine cradle portion 240 which extends rearwardly along the longitudinal axis of the snowmobile 230. While hidden behind a front fairing 254, a two-stroke engine 10 in accordance with the present invention, schematically illustrated, is mounted to the engine cradle portion 240 of the frame 236 and provides motive force for the snowmobile 230.

Two front skis 242 are attached to the front portion of the frame 236 through a front suspension system 200. The front suspension system 200 generally comprises a double A-arm type suspension, having upper A-arms 208 and lower A-arms 206 on either side of the vehicle linking spindles 210 to the frame 236. The spindles 210 are attached to the skis 242 at their lower ends and rotate left and right therewith. The spindles 210 are also connected to a steering column 250 via steering rods 231. The steering column 250 is attached at its upper end to a steering device such as a handlebar 252 which is positioned forward of a rider and slightly behind the two-stroke engine 10 to rotate the skis 242, thereby providing directional control of the snowmobile 230. Thus, by turning the steering device 252, the spindles 210 are pivoted and the skis 242 are turned to steer the snowmobile 230 in a desired direction.

An endless drive track 260, which provides propulsion to the snowmobile 230, is disposed under the tunnel 296 of the frame 236 with the upper portion of the drive track 260 accommodated within the tunnel 296. The endless drive track 260 is operatively connected to the two-stroke engine 10 through a belt transmission system 262 which is schematically illustrated with broken lines. The drive train of the snowmobile 230 includes all the components of the snowmobile 230 whose function is to transmit power from the engine to the ground including the belt transmission assembly. The endless drive track 260 is mounted to the tunnel 296 via a rear suspension assembly 264. The rear suspension assembly 264 includes rear suspension arms 272 and 274, a pair of slide rails 266 which generally position and guide the endless drive track 260 and idler wheels 268 engaged therewith. Rear suspension arms 272 and 274 connect the slide rails 266 and idler wheels 268 to the tunnel 296 of the frame 236. The slide rails 266 typically include a sliding lower surface made of polyethylene to reduce contact friction between the slide rails 266 and the drive track 260. The rear suspension assembly 264 also includes one or more shock absorbers 270 which may further include a coil spring (not shown) surrounding the individual shock absorbers 270.

At the front end 232, the snowmobile 230 includes an external shell consisting of fairings 276 that enclose and protect the two-stroke engine 10 and transmission 262 and that can be decorated to render the snowmobile 230 more aesthetically pleasing. Typically, the fairings 276 include a hood 278 and one or more side panels 280 which can be opened to allow access to the two-stroke engine 10 and the transmission 262 when this is required, for example, for inspection or maintenance. The side panels 280 can be opened away from the snowmobile 230 along a vertical axis, independently from the hood 278, which pivots forward about a horizontally extending axis. A windshield 282, which may be connected either to the fairings 276 or directly to the handlebars 252, acts as wind deflector to lessen the force of the air on the rider when the snowmobile is moving.

A straddle-type seat 288 is positioned atop and mounted to the tunnel 296. At the rear of the straddle seat 288, a storage compartment 290 is provided. A passenger seat (not shown) can also be provided instead of the storage compartment 290. Two footrests 284, generally extending outwardly from the tunnel 296, are also positioned on either side of the straddle seat 288 to accommodate the rider's feet and provide a rigid platform for the rider to stand on when maneuvering the snowmobile 230.

Modifications and improvement to the above described embodiments of the present invention may become apparent to those skilled in the art. The foregoing description is intended to be exemplary rather than limiting. Furthermore, the dimensions of features of various components that may appear on the drawings are not meant to be limiting, and the size of the components therein can vary from the size that may be portrayed in the figures herein. The scope of the present invention is therefore intended to be limited solely by the scope of the appended claims.

What is claimed is:

1. An internal combustion engine having an exhaust side and a side opposite the exhaust side, the engine comprising:

a crankcase, a crankshaft adapted to rotate about a crankshaft axis, and at least two bearings supporting the crankshaft within the crankcase;

at least one cylinder having a cylinder axis and a cylinder head above the at least one cylinder, the at least one cylinder and the cylinder head together defining at least one combustion chamber, the exhaust side of the engine being disposed on one side of a central plane of the engine defined by the cylinder axis and the crankshaft axis;

a piston disposed in the at least one cylinder and operatively connected to the crankshaft;

an intake port connected to the at least one cylinder for allowing at least one combustion component to enter the at least one combustion chamber;

an exhaust port connected to the at least one cylinder for allowing exhaust gas to exit the at least one combustion chamber; and a liquid cooling circuit including:

a cylinder cooling jacket at least partially surrounding the at least one cylinder, and at least one cooling passageway on the side opposite the exhaust side of the engine, the side opposite the exhaust side being disposed on an other side of the central plane of the engine, the at least one cooling passageway being disposed above the crankshaft axis and extending from the crankcase to the cylinder head;

the internal combustion engine operating on a two-stroke principle.

2. An internal combustion engine as defined in claim 1, wherein the crankcase is horizontally split into an upper half and a lower half, the at least one cooling passageway on the side opposite the exhaust side of the engine beginning in the upper half of the crankcase.

3. An internal combustion engine as defined in claim 2, wherein the cooling circuit further comprises at least one passageway on the exhaust side of the engine within the upper half of the crankcase and at least one channel traversing the upper half of the crankcase and connecting the at least one passageway on the side opposite the exhaust side of the engine with the at least one cooling passageway on the exhaust side of the engine.

4. An internal combustion engine as defined in claim 3, wherein the at least one channel traversing the upper half of the crankcase is located in the vicinity of one of the at least two bearings supporting the crankshaft for cooling the one of the at least two bearings.

5. An internal combustion engine as defined in claim 3, wherein the at least one channel traversing the upper half of the crankcase is located adjacent one of the at least two bearings supporting the crankshaft for cooling the one of the at least two bearings.

6. An internal combustion engine as defined in claim 3, wherein the at least one channel is one of a plurality of channels traversing the upper half of the crankcase, each of the plurality of channels being aligned with one of the at least two crankshaft bearings.

7. An internal combustion engine as defined in claim 1, wherein the at least one passageway on the side opposite the exhaust side of the engine traverses the intake port connected to the at least one cylinder.

8. An internal combustion engine as defined in claim 7, wherein the at least one cylinder includes supporting members for maintaining the structural integrity of the at least one cylinder, the at least one passageway on the side opposite the exhaust side of the engine traversing the intake port being located within at least one of the supporting members.

9. An internal combustion engine as defined in claim 8, wherein at least one of the supporting members traverses the intake port connected to the at least one cylinder.

10. An internal combustion engine as defined in claim 1, wherein the cooling circuit further comprises at least one cooling chamber disposed below the crankshaft axis for cooling a lower portion of the at least two bearings supporting the crankshaft.

11. An internal combustion engine as defined in claim 10, wherein the crankcase defines the at least one cooling chamber, the crankcase including at least one partition wall inside the at least one cooling chamber for directing cooling fluid inside the at least one cooling chamber.

12. An internal combustion engine as defined in claim 10, wherein the at least one cooling chamber is in fluid communication with the at least one cooling passageway on the side opposite the exhaust side of the engine disposed above the crankshaft axis via at least one cooling channel disposed above the crankshaft axis and traversing the crankcase.

13. An internal combustion engine as defined in claim 1, further comprising:

at least one crankcase chamber located at least partially in the crankcase below the piston, and at least one transfer port, the at least one crankcase chamber in fluid communication with the intake port of the combustion chamber via the at least one transfer port.

14. An internal combustion engine as defined in claim 1, wherein the side opposite the exhaust side of the engine is the intake side of the engine.

15. An internal combustion engine having an exhaust side and a side opposite the exhaust side, the engine comprising:

a crankcase, a crankshaft adapted to rotate about a crankshaft axis, and at least two bearings supporting the crankshaft within the crankcase;

at least one cylinder having a cylinder axis, and a cylinder head above the at least one cylinder, the at least one cylinder and the cylinder head together defining at least one combustion chamber;

a central plane of the engine defined by the cylinder axis and the crankshaft axis, the central plane separating the exhaust side of the engine from the side opposite the exhaust side of the engine;

a piston disposed in the cylinder and operatively connected to the crankshaft;

an intake port connected to the at least one cylinder for allowing at least one combustion component to enter the at least one combustion chamber;

an exhaust port connected to the at least one cylinder for allowing exhaust gas to exit the at least one combustion chamber; and a liquid cooling circuit including:

a cylinder cooling jacket at least partially surrounding the at least one cylinder, a first cooling passageway within the crankcase disposed below the crankshaft axis, and a second cooling passageway within the crankcase disposed above the crankshaft axis;

the first and second passageways extending across the central plane of the engine, the internal combustion engine operating on a two-stroke principle.

16. A two-stroke internal combustion engine as defined in claim 15, wherein the second cooling passageway is one of a plurality of cooling passageways disposed above the crankshaft axis.

17. A two-stroke internal combustion engine as defined in claim 16, wherein the plurality of cooling passageways are aligned with the at least two crankshaft bearings.

18. A two-stroke internal combustion engine as defined in claim 15, wherein the crankcase is horizontally split into an upper half and a lower halt the liquid cooling circuit further comprising at least one cooling channel traversing the upper half of the crankcase and connecting the first and second passageways.

19. A two-stroke internal combustion engine as defined in claim 18, wherein the at least one cooling channel traversing the upper half of the crankcase is one of a plurality of cooling channels traversing the upper half of the crankcase, the plurality of cooling channels aligned with the at least two crankshaft bearings.

20. A two-stroke internal combustion engine as defined in claim 19, wherein the plurality of cooling channels cools an upper half of the at least two crankshaft bearings.

21. A two-stroke internal combustion engine as defined in claim 19, wherein the first cooling passageway within the crankcase cools a lower half of the at least two crankshaft bearings.

22. An internal combustion engine as defined in claim 15, wherein the side opposite the exhaust side of the engine is the intake side of the engine.

23. A snowmobile comprising:

a frame having a forward end and a rearward end;

a drive track assembly disposed below and supporting the rearward end of the frame;

a front suspension connected to the forward end of the frame;

two skis connected to the front suspension;

a two-stroke engine mounted on the frame and operatively connected to the drive track via a drive train for delivering propulsive power to the drive track;

the two-stroke engine comprising:

a crankcase, a crankshaft adapted to rotate about a crankshaft axis, and at least two bearings supporting the crankshaft within the crankcase;

at least one cylinder having a cylinder axis and a cylinder head above the at least one cylinder, the at least one cylinder and the cylinder head together defining at least one combustion chamber;

a central plane of the engine defined by the cylinder axis and the crankshaft axis, the central plane separating an exhaust side of the engine from a side opposite the exhaust side of the engine;

a piston disposed in the at least one cylinder and operatively connected to the crankshaft;

an intake port connected to the at least one cylinder for allowing at least one combustion component to enter the at least one combustion chamber;

an exhaust port connected to the at least one cylinder for allowing exhaust gas to exit the at least one combustion chamber; and a liquid cooling circuit including a cylinder cooling jacket at least partially surrounding the at least one cylinder, a first cooling passageway within the crankcase disposed below the crankshaft axis and a second cooling passageway disposed above the crankshaft axis;

the first and second passageways extending across the central plane of the engine.

24. A snowmobile as defined in claim 23, wherein the frame includes a tunnel made at least in part of bent sheet metal.

* * * * *

UNITED STATES PATENT AND TRADEMARK OFFICE

CERTIFICATE OF CORRECTION

PATENT NO. : 7,644,687 B2
APPLICATION NO. : 11/625680
DATED : January 12, 2010
INVENTOR(S) : Gunther Zauner It is certified that error appears in the above-identified patent and that said Letters Patent is hereby corrected as shown below:

Column 12, line 3, "a lower halt the liquid" should be changed to
-- a lower half, the liquid --

Signed and Sealed this

Eleventh Day of May, 2010

David J. Kappos

David J. Kappos
*Director of the United States Patent and Trademark Office*